US005546631A

United States Patent [19]

Chambon

[11] Patent Number: 5,546,631

[45] Date of Patent: Aug. 20, 1996

[54] WATERLESS CONTAINER CLEANER MONITORING SYSTEM

[76] Inventor: Michael D. Chambon, 3636 Corinne Ave., Chalmette, La. 70043-1500

[21] Appl. No.: 332,253

[22] Filed: Oct. 31, 1994

[51] Int. Cl.[6] ..... A47L 15/00; A47L 5/14

[52] U.S. Cl. ..... 15/319; 15/304; 15/345

[58] Field of Search ..... 15/304, 319, 339, 15/345, 346

[56] References Cited

U.S. PATENT DOCUMENTS

| | | | |
|---|---|---|---|
| 2,644,188 | 7/1953 | Pacilio | 15/304 |
| 3,495,291 | 2/1970 | Copping et al. | 15/304 |
| 4,199,838 | 4/1980 | Simonsson | 15/339 |
| 4,361,759 | 11/1982 | King et al. | 250/223 R |
| 4,635,662 | 1/1987 | Totten | 134/68 |
| 4,701,192 | 10/1987 | Burke | 15/319 |
| 5,017,242 | 5/1991 | Anderson | 134/22.18 |
| 5,033,151 | 7/1991 | Kraft | 15/339 |
| 5,279,017 | 1/1994 | Foreshew | 15/304 |
| 5,313,990 | 5/1994 | Clüsserath | 141/6 |

FOREIGN PATENT DOCUMENTS

| | | | |
|---|---|---|---|
| 524395 | 5/1931 | Germany | 15/304 |
| 2006837 | 8/1971 | Germany | 15/339 |
| 4189333 | 7/1992 | Japan | 15/319 |
| 4327823 | 11/1992 | Japan | 15/319 |

*Primary Examiner*—David Scherbel
*Assistant Examiner*—Randall E. Chin
*Attorney, Agent, or Firm*—Joseph N. Breaux

[57] ABSTRACT

A monitoring system for use in a waterless container cleaner of the type having a pressure blower, a pressurized air line having a pressurized air line filter, a vacuum blower, a vacuum air line having a vacuum air line filter, a compressed air line having a compressed air line filter, and a compressed air line regulator having a reservoir for collecting condensation within the compressed air line, is described. The monitoring system comprises: a digital controller, a visual display unit, and three pressure differential sensor switches. Preferred embodiments of the waterless container monitoring system include: a dew point monitor, a container gap sensor switch, a flow rate sensor switch, and a level detector mechanism.

20 Claims, 2 Drawing Sheets

10
11
12
13
14
15
16
17
18
19
20
21
22
23
24
25
26
27
28
30
31
32
33
34
35
36
37
38
39
40
42
44
46
48
50
52
61
63
Y

WATERLESS CONTAINER CLEANER MONITORING SYSTEM

TECHNICAL FIELD

The present invention relates to devices and methods for monitoring the operation of a waterless container cleaner and, more particularly, to devices and methods for monitoring the operation of a waterless container cleaner that monitors various operating parameters and halts operation of the container cleaner when operating parameter limits are exceeded.

BACKGROUND ART

Traditionally, containers, such as soda cans and bottles, have been cleaned by merely rinsing them out with clean, pressurized water. Once the pressurized water has been turned on, the flow of water could be depended upon to continue during packaging operations.

Recently another type of container cleaner has gained acceptance in the industry. These systems clean the containers with compressed air instead of water. They have been proven to clean containers significantly better than the water-type cleaning systems and include the additional advantages of reduced water and sewerage charges.

The air cleaners use compressed air, blowers, flow meters, static control systems, liquid detectors, and filtering systems to accomplish the cleaning. After the container enters a cleaning chamber, the compressed air is directed through a nozzle into the container to dislodge foreign solids and fluids. A pressure blower and a vacuum blower act in conjunction to continuously exchange the air within the cleaning chamber to remove the air contaminated with these foreign solids and fluids. The vacuum blower removes the contaminated air from the cleaning chamber while the pressure blower continuously supplies clean filtered air to replace the contaminated air removed from the cleaning chamber. Because of the increased complexity of the cleaning system it is prone to hidden failures which can lead to the filling of unclean containers. The sale of products packaged in these unclean containers can lead to injuries to end users and increased costs for packing facilities through increased product liability claims, as well as, losses in sales. It would be a benefit, therefore, to have a method or device for monitoring the operation of the elements within an air cleaner system which would either alert an operator of the existing conditions or halt operation of the air cleaner until corrective measures have been taken.

SUMMARY OF THE INVENTION

It is thus an object of the invention to provide a waterless container cleaner monitoring system that monitors the pressure differential across the container cleaner air filters.

It is a further object of the invention to provide a waterless container cleaner monitoring system that monitors and detects a change in the flow rate of the container cleaner compressed air lines.

It is a still further object of the invention to provide a waterless container cleaner monitoring system that includes a dew point detector which monitors the dampness of the air in the container cleaner compressed air lines.

It is a still further object of the invention to provide a waterless container cleaner monitoring system that includes a container gap sensor which provides a visual indication of the existence of a gap in the container cleaning queue.

It is a still further object of the invention to provide a waterless container cleaner monitoring system that provides a visual display output which indicates the existence of a system alarm condition to an operator.

It is a still further object of the invention to provide a waterless cleaner monitoring system which accomplishes some or all of the above objectives.

Accordingly, a monitoring system for use in a waterless container cleaner of the type having a pressure blower, a pressurized air line having a pressurized air line filter, a vacuum blower, a vacuum air line having a vacuum air line filter, a compressed air line having a compressed air line filter, and a compressed air line regulator having a reservoir for collecting condensation within the compressed air line, is described. The monitoring system comprises: a digital controller, a visual display unit, and three pressure differential sensor switches.

The digital controller has a plurality of inputs and at least one output. The digital controller is programmed to receive input signals from the pressure differential switches and halt cleaner operations, provide a visual display indicating the nature of the alarm condition, and/or otherwise alert an operator, when an alarm condition is detected. It is preferred to use a programmable digital controller such as an Allen-Bradley Programmable Controller #SLC-150 1745-LP151, manufactured by Allen-Bradley Company, Milwaukee, Wis., however, any digital controller capable of providing a predetermined output in response to the various input signals received is sufficient to practice the invention.

The visual display unit is in electrical connection with at least one output of the controller. The visual display unit displays a plurality of predetermined messages in response to receipt of various signals from the controller. It is preferred to use a programmable digital display unit such as a Vorne Digital Display #2015C-L-120-C; Manufactured by Vorne Industries, Incorporated, Chicago Ill. This unit may be programmed to display up to 255 messages in response to predetermined signals from the controller. Although a programmable digital display unit is preferred, any device which will visually alert an operator of the existence and identity of an alarm condition within the monitoring system is sufficient to practice the invention. For example a panel having a plurality of lights and a caption for each light would be within the scope of the term "visual display unit".

The first differential pressure sensor switch has a first and second pressure input, for sensing the pressure differential across the compressed air line filter. The first pressure input is in functional connection with the compressed air line at a location downstream from the compressed air line filter. The second pressure input is in functional connection with the compressed air line at a location upstream from the compressed air line filter. The term "functional connection" as used herein means physically positioned in a manner such that the element functions in the manner in which it is intended to function. Thus there need be no actual physical connection in order for there to be a "functional connection". The first differential pressure sensor switch has an electrical output in connection with an input of the controller which supplies an input signal to the controller when a predetermined pressure differential level is sensed across the compressed air line filter. The predetermined pressure differential level is preferably less than 15 PSI, more preferably between 3 and 12 PSI, and most preferably between 5 and 9 PSI. It is preferred to use a differential type pressure switch such as an Omega Controls #PSW-152, Omega Engineering Company, Stamford, Conn., however, any differential pressure sensing mechanism capable of providing an output signal to the controller upon sensing a predetermined pressure differential is sufficient to practice the invention.

The second differential pressure sensor switch has a third and fourth pressure input, for sensing the pressure differential across the pressurized air line filter. The third pressure input is in functional connection with the pressurized air line at a location downstream from the pressurized air line filter. The fourth pressure input is in functional connection with the pressurized air line at a location upstream from the pressurized air line filter. The second differential pressure sensor switch has an electrical output in connection with an input of the controller which supplies an input signal to the controller when a predetermined pressure differential level is sensed across the pressurized air line filter. The predetermined pressure differential level is preferably less than a five inch water column, more preferably less than a three inch water column and most preferably between a one-half inch and one and one-half inch water column. It is preferred to use a differential type pressure switch such as a Columbus Electric #RH3A, manufactured by Columbus Electric, Piney Flats, Tenn., however, any differential pressure sensing mechanism capable of providing an output signal to the controller upon sensing a predetermined pressure differential is sufficient to practice the invention.

The third differential pressure sensor switch has a fifth and sixth pressure input, for sensing the pressure differential across the vacuum air line filter. The fifth pressure input is in functional connection with the vacuum air line at a location downstream from the vacuum air line filter. The sixth pressure input is in functional connection with the vacuum air line at a location upstream from the vacuum air line filter. The third differential pressure sensor switch has an electrical output in connection with an input of the controller which supplies an input signal to the controller when a predetermined pressure differential level is sensed across the vacuum air line filter. The predetermined pressure differential level is preferably less than a five inch water column, more preferably less than a three inch water column and most preferably between a one-half inch and one and one-half inch water column. It is preferred to use a differential type pressure switch such as a Columbus Electric #RH3A, manufactured by Columbus Electric, Piney Flats, Tenn. however, any differential pressure sensing mechanism capable of providing an output signal to the controller upon sensing a predetermined pressure differential is sufficient to practice the invention.

It has been found by the inventor hereof that monitoring the differential pressure across the container cleaner's air line filters allows the monitoring system to detect the presence of dirty, clogged filter(s) before the dirty, clogged condition of the filter(s) begins to significantly degrade the efficacy of the container cleaner. In addition, detecting dirty, clogged filter(s) before they significantly degrade cleaning operations allows the filters to be replaced during the next scheduled maintenance period and, thus, reduces costly, unscheduled shut downs.

In a preferred embodiment, the waterless container monitoring system further includes: a dew point monitor. The dew point monitor has a dew point transducing element in functional connection with the compressed air line of a container cleaning system and senses the dew point of the compressed air within the compressed air line. The dew point monitor has an electrical output, in connection with an input of the controller, which supplies an input signal to the controller when a predetermined set point level is sensed within the compressed air line. It is preferred to use a dew point monitor such as a Genesis Dew Point Monitor, manufactured by General Eastern Instruments, Woburn, Mass., however, any sensing unit which can detect a predetermined set point level and provide an output signal to the controller is sufficient to practice the invention. The set point is preferably less than about 10 degrees Celsius, more preferably less than 3 degrees Celsius, and most preferably between 1 and 2.5 degrees Celsius.

In another preferred embodiment, the waterless container cleaner monitoring system further includes: a container gap sensor switch, having an electrical output in connection with an input of the controller, for detecting the presence of a gap in a container cleaning queue. The container gap sensor switch supplies an input signal to the controller when a gap is sensed between containers in the container cleaning queue. It is preferred to use a proximity type sensor for determining the existence of a gap in the container queue, however, any sensing or detecting unit capable of detecting a gap and providing an output signal to the controller in response to detecting a gap is sufficient to practice the invention.

The purpose of the container gap sensor switch is to detect gaps existing in the container filling queue and signal the controller of the existence of a gap. These gaps generally occur during shut downs of the packaging system. When these gaps exist on the downstream side of the container cleaner, containers pass through the container cleaner at rates which exceed the maximum rate at which the containers can be adequately cleaned. Thus, the presence of a gap raises the possibility that inadequately cleaned containers have reached the filling section. The controller can be programmed to take a variety of actions including halting container cleaning operations, sending a signal to a visual display unit, and/or activating an audible or visual alarm device.

In another preferred embodiment, the waterless container cleaner monitoring system further includes: a flow rate sensor switch, in connection with the compressed air line, for sensing the flow of compressed air through the compressed air line. The flow rate sensor switch has an electrical output in connection with an input of the controller which supplies an input signal to the controller when the flow rate of the compressed air through the compressed air line does not fall within a predetermined flow rate range. The predetermined flow rate range is preferably between 100 and 500 cubic feet per hour, more preferably between 150 and 450 cubic feet per hour, and most preferably between 200 and 300 cubic feet per hour. Any flow rate sensor capable of detecting a predetermined flow rate and outputting a signal to the controller in response to detecting the predetermined flow rate is sufficient to practice the invention.

The purpose of the flow rate sensor is to ensure that the compressed air line is dispensing compressed air at a rate sufficient to insure proper cleaning of the containers. When the flow rate falls outside the predetermined flow rate range the controller receives an input signal from the flow rate sensor and the controller then, depending on the exact configuration implemented, initiates one or more of the following actions: halts operation of the container cleaner, sends a signal to a visual display unit, activates an audible or visual alarm device.

In another preferred embodiment, the waterless container cleaner monitoring system further includes: a level detector mechanism, in functional connection with the reservoir of the compressed air line regulator, for sensing the accumulation of condensation in the compressed air line. The level detector mechanism has an electrical output in connection with an input of the controller which supplies an input signal to the controller when a predetermined condensation level is sensed within the reservoir. The predetermined condensation level is preferably less than 3 inches, more preferably between 1 and 2.5 inches, and most preferably less than about 2 inches. It is preferred to use a float switch mounted within the reservoir as the level detecting mechanism, however, any sensing mechanism capable of detecting a predetermined fluid level within the reservoir and outputting a signal to the controller in response to detecting the predetermined level is sufficient to practice the invention.

The presence of a significant level of condensate in the reservoir of the compressed air line regulator indicates a moisture level within the compressed air lines which may effect the cleaner's ability to adequately clean the containers. Moisture can pose at least two problems to the cleaning process. The first problem is the introduction of moist air into the cleaning process increases the chances that particulate matter will adhere to a container surface. The second problem is any increase in moisture content in the compressed air increases the ability of the compressed air to transmit dangerous bacterial organisms. Thus, instead of cleaning the containers, the cleaner is actually contaminating the containers. By alerting the operator at an early stage in the accumulation, corrective measures may be taken to insure the safety of the air within the compresses air lines.

In another aspect of the invention, another embodiment of the monitoring system is provided. In this embodiment, the monitoring system comprises: a digital controller, a visual display unit, and a moisture detecting mechanism.

The digital controller, and the visual display unit are connected and operate as previously described. The moisture detecting mechanism is in functional connection with the compressed air within the compressed air line and is used to sense the moisture level of the compressed air within the compressed air line. The moisture detecting mechanism has an electrical output in connection with an input of the controller which supplies an input signal to the controller when a predetermined moisture level is sensed within the compressed air line.

In a preferred embodiment, the moisture detecting mechanism includes a level detector switch in functional connection with the reservoir of the compressed air line regulator for sensing the level of accumulated condensation in the reservoir. The level detector switch has an electrical output in connection with an input of the controller which supplies an input signal to the controller when a predetermined condensation level is sensed within the reservoir.

In another preferred embodiment, the moisture detecting mechanism includes a dew point monitor having a dew point transducing element in functional connection with the compressed air line of the container cleaning system, for sensing the dew point of the compressed air within the compressed air line. The dew point monitor has an electrical output, in connection with an input of the controller which supplies an input signal to the controller when a predetermined set point level is sensed within the compressed air line.

In another preferred embodiment, the waterless container cleaner monitoring system further includes: a flow rate sensor switch, in connection with the compressed air line, for sensing the flow of compressed air through the compressed air line. The flow rate sensor switch has an electrical output in connection with an input of the controller which supplies an input signal to the controller when the flow rate of the compressed air through the compressed air line falls outside of a predetermined flow rate range.

In another preferred embodiment, the waterless container cleaner monitoring system further includes: a container gap sensor switch, for detecting the presence of a gap in the container cleaning queue, having an electrical output in connection with an input of the controller which supplies an input signal to the controller when a gap is sensed between containers in the container cleaning queue.

In a further aspect of the invention, a method of monitoring the operations of a waterless container cleaner of the type having a pressure blower, a pressurized air line having a pressurized air line filter, a vacuum blower, a vacuum air line having a vacuum air line filter, a compressed air line having a compressed air line filter, and a compressed air line regulator having a reservoir for collecting condensation within the compressed air line, is provided. The method comprises the steps of: a) providing a monitoring system comprising: a digital controller having a plurality of inputs and at least one output; a visual display unit in electrical connection with an output of the controller, the visual display unit displaying a plurality of predetermined messages in response to receipt of various signals from the controller; a first differential pressure sensor switch, having a first and second pressure input, for sensing the pressure differential across the compressed air line filter, the first differential pressure sensor switch having an electrical output in connection with an input of the controller, the first differential pressure sensor switch supplying an input signal to the controller when a predetermined pressure differential level is sensed across the compressed air line filter; a second differential pressure sensor switch, having a third and fourth pressure input, for sensing the pressure differential across the pressurized air line filter, the second differential pressure sensor switch having an electrical output in connection with an input of the controller, the second differential pressure sensor switch supplying an input signal to the controller when a predetermined pressure differential level is sensed across the pressurized air line filter; a third differential pressure sensor switch, having a fifth and sixth pressure input, for sensing the pressure differential across the vacuum air line filter, the third differential pressure sensor switch having an electrical output in connection with an input of the controller, the third differential pressure sensor switch supplying an input signal to the controller when a predetermined pressure differential level is sensed across the vacuum air line filter; b) installing the first pressure input in functional connection with the compressed air line at a location downstream from the compressed air line filter; c) installing the second pressure input in functional connection with the compressed air line at a location upstream from the compressed air line filter; d) installing the third pressure input in functional connection with the pressurized air line at a location downstream from the pressurized air line filter; e) installing the fourth pressure input in functional connection with the pressurized air line at a location upstream from the pressurized air line filter; f) installing the fifth pressure input in functional connection with the vacuum air line at a location downstream from the vacuum air line filter; and g) installing the sixth pressure input in functional connection with the vacuum air line at a location upstream from the vacuum air line filter.

In a preferred method the monitoring system provided further comprises: a level detector mechanism for sensing the level of accumulated condensation in the reservoir, the level detector mechanism having an electrical output in connection with an input of the controller, the level detector mechanism supplying an input signal to the controller when a predetermined condensation level is sensed within the reservoir; and the method further includes the step of: installing the level detector mechanism in functional connection with the reservoir of the compressed air line regulator.

In another preferred method the monitoring system provided further comprises: a flow rate sensor switch for sensing the flow of compressed air through the compressed air line, the flow rate sensor switch having an electrical output in connection with an input of the controller, the flow rate sensor switch supplying an input signal to the controller when the flow rate of the compressed air through the compressed air line falls outside of a predetermined flow rate range; and wherein the method further includes the step of: installing the flow rate sensor switch in connection with the compressed air line.

In another preferred method, the monitoring system provided further comprises: a container gap sensor switch, having an electrical output in connection with an input of the controller, for detecting the presence of a gap between containers in a container cleaning queue, the container gap sensor switch supplying an input signal to the controller when a gap is sensed between containers in the container cleaning queue; and wherein the method further includes the step of: installing the container gap sensor switch in proximity to the container cleaning queue in a manner such that the container gap sensor switch may sense gaps within the container cleaning queue.

In another preferred method the monitoring system provided further comprises: a dew point monitor, having a dew point transducing element, for sensing the dew point of the compressed air within the compressed air line, the dew point monitor having an electrical output, in connection with an input of the controller, the dew point monitor supplying an input signal to the controller when a predetermined set point level is sensed within the compressed air line, and the method further includes the step of: installing the dew point transducing element in functioned connection with the compressed air lane of the container cleaning system.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE PREFERRED EMBODIMENT

Figure 1:
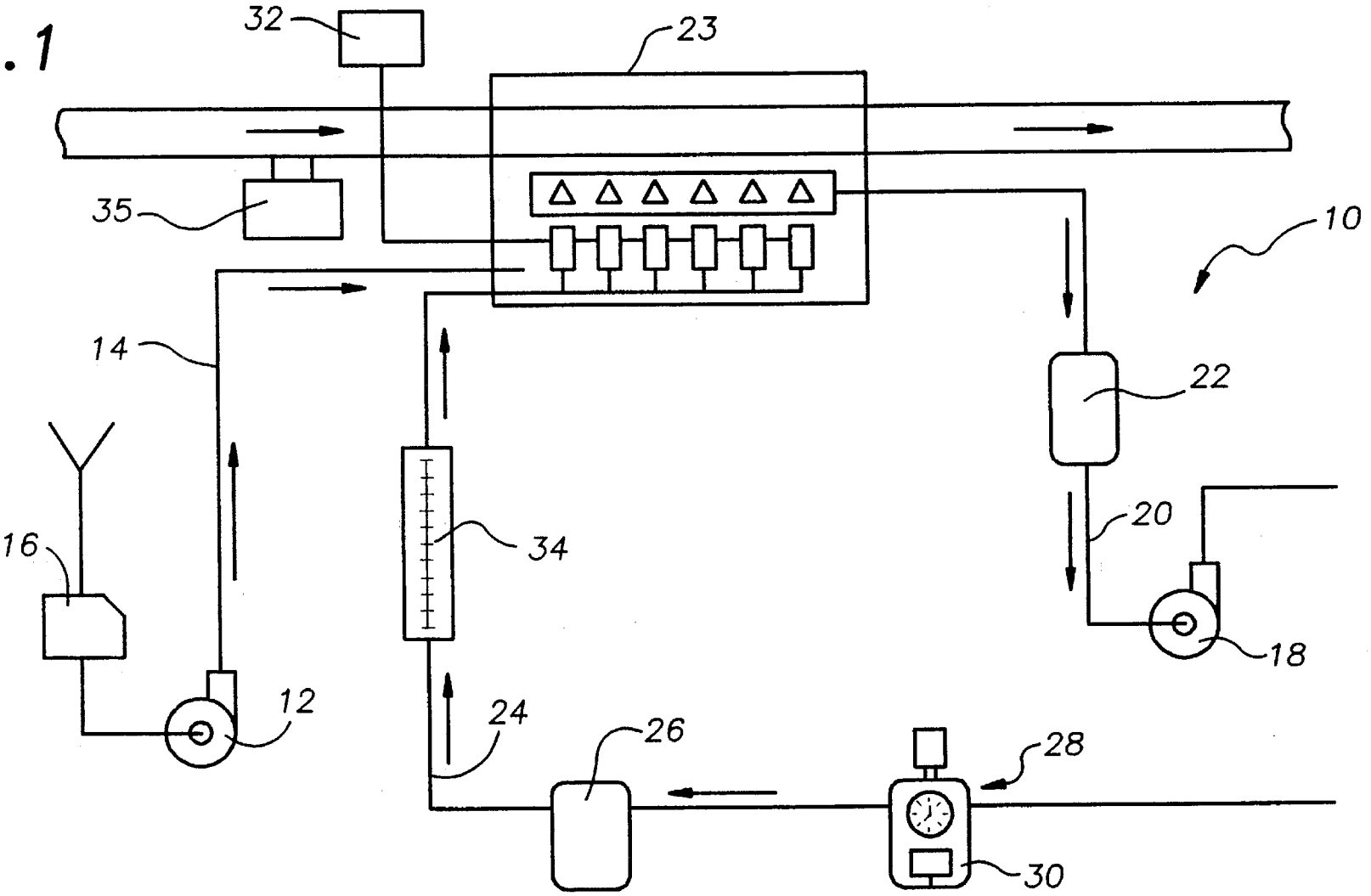
FIG. 1 is a schematic diagram of a typical waterless container cleaner.

FIG. 1 is a schematic diagram of an existing waterless container cleaner, generally designated by the numeral 10. As shown in the diagram waterless container cleaner 10 includes a pressure blower 12, a pressurized air line 14 having a pressurized air line filter 16, a vacuum blower 18, a vacuum air line 20 having a vacuum air line filter 22, a compressed air line 24 having a compressed air line filter 26, and a compressed air line regulator 28 having a reservoir 30 for collecting condensation within compressed air line 24. Pressurized air line 14, vacuum air line 20, and compressed air line 24 all terminate within a cleaning chamber 23. Container cleaner 10 also includes a static control system 32, a flow meter 34, and liquid monitoring device 35.

The static control system 32 eliminates static charges that may exist on particulate matter which may exist within the containers to be cleaned. This allows the compressed air to dislodge the particulate matter with less force and thus enhances container cleaner 10's cleaning efficiency. The liquid monitoring device 35 monitors incoming containers for the presence of liquid that could hinder the cleaning process. Both static control system 32 and liquid monitoring device 35 have alarm contacts which are utilized in the exemplary embodiment described herein below.

Figure 2:
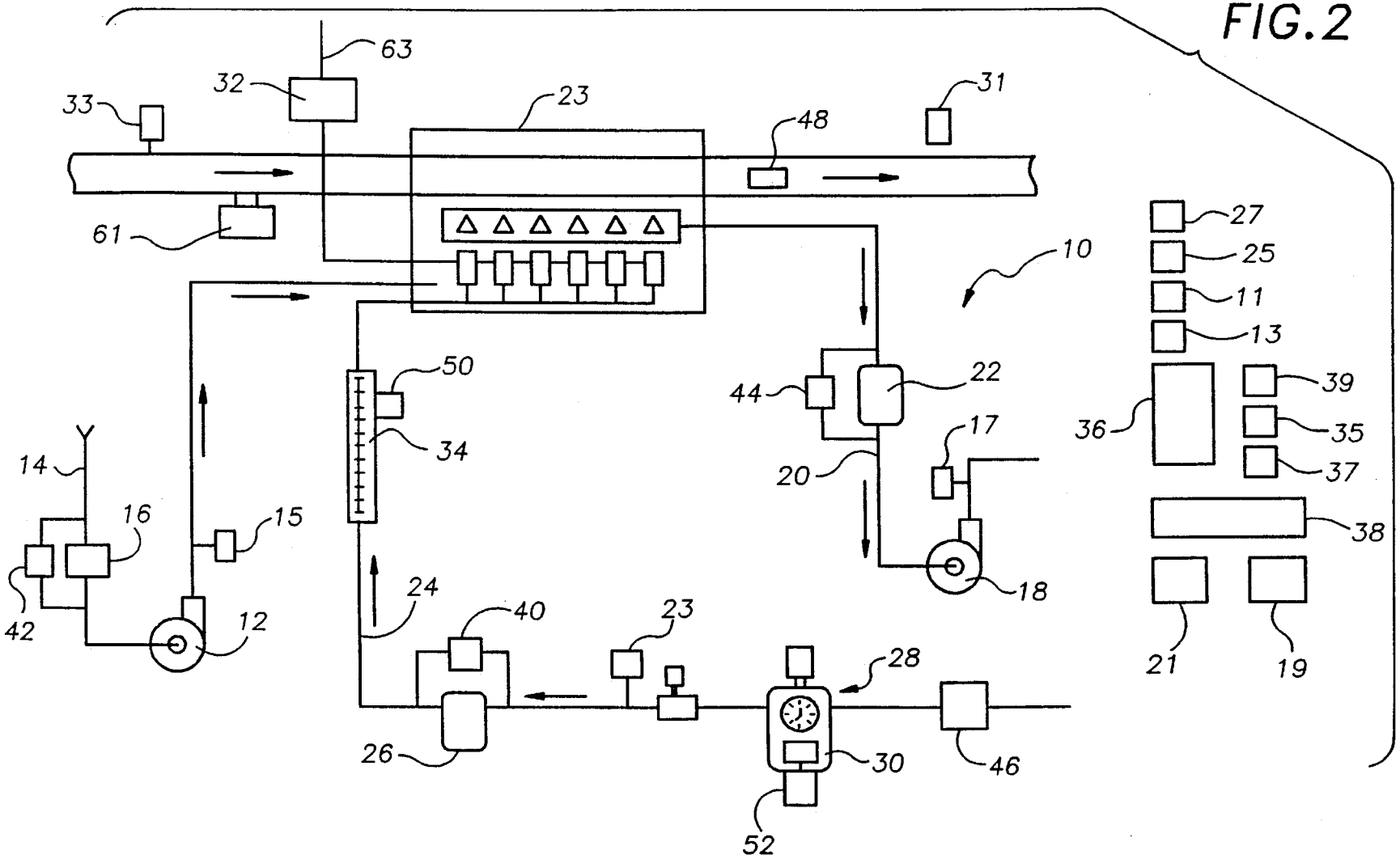
FIG. 2 is a schematic diagram of the container cleaner diagramed in FIG. 1 with an embodiment of the monitoring system in place.

With reference to FIG. 2, as discussed previously, the monitoring system of the invention is for use in a waterless container cleaner 10. In this embodiment the monitoring system comprises: a digital controller 36, a visual display unit 38, a first 40, second 42, and third 44, pressure differential sensor switch, a dew point monitor 46, a container gap sensor switch 48, a flow rate sensor switch 50, and a level detector mechanism 52. The monitoring system also includes: a start button 11, for starting blowers 12,18; a stop button 13, for stopping blowers 12,18; a pressure blower proving switch 15, for supplying an input to controller 36 indicating the status of pressure blower 12; a vacuum blower proving switch 17, for supplying an input to controller 36 indicating the status of vacuum blower 18; a pressure blower motor overload 19, for supplying an input to controller 36 indicating an overload condition; a vacuum blower motor overload 21, for supplying an input to controller 36 indicating an overload condition; a compressed air pressure switch 23, for supplying an input to controller 36 indicating the detection of pressurized air within air line 24; a fault override key switch 25, for supplying an input to controller 36 indicating the desire to override the monitoring system by an operator; and a fault reset push button 27, for supplying an input to controller 36 indicating the desire to reset the controller program to a no fault condition.

The digital controller 36 is an Allen-Bradley Programmable Controller #SLC-150 1745-LP151 which includes twenty controller inputs (CI-1 through CI-10 and CI-101 through CI-110) and twelve controller outputs (CO-11 through CO-16 and CO-111 through CO-116). In this exemplary embodiment, digital controller 36 is programmed to receive eighteen input signals and supply twelve output signals. The eighteen inputs are received at the following inputs:

| | |
|---|---|
| CI-1 | Start button (11) |
| CI-2 | Stop button (13) |
| CI-3 | Pressure blower proving switch (15) |
| CI-4 | Vacuum blower proving switch (17) |
| CI-5 | Pressure blower motor overload (19) |
| CI-6 | Vacuum blower motor overload (21) |
| CI-7 | Compressed air pressure switch (23) |
| CI-8 | Liquid detection system alarm contacts (61) |
| CI-9 | Static control system alarm contacts (63) |
| CI-10 | Flow rate sensor switch (50) |
| CI-101 | Second pressure differential sensor switch (42) |
| CI-102 | Third pressure differential sensor switch (44) |
| CI-103 | First pressure differential sensor switch (40) |
| CI-104 | Level detector mechanism (52) |
| CI-105 | Fault override key switch (25) |
| CI-106 | Fault reset push button (27) |
| CI-107 | Not used |
| CI-108 | Dew point monitor (46) |

-continued

| | |
|---|---|
| CI-109 | Container gap sensor switch (48) |
| CI-110 | Not used |

The twelve output signals are supplied to the following devices: a downstream control 31, for stopping the flow of containers downstream from cleaner 10; visual display unit 38, for indicating the desired operation of visual display unit 38; an upstream control 33, for stopping the flow of containers upstream from cleaner 10; an alert strobe 35, for providing a visual signal indicating an alarm condition; a display reset 37, for resetting the display of visual display unit 38; and a flashing orange pilot light 39 connected to fault reset button 27. The connections between the preceding devices and controller 36 are as follows:

| | |
|---|---|
| CO-11 | Downstream control (31) |
| CO-12 | Visual display (38) input: data bit #0 |
| CO-13 | Visual display (38) input: data bit #1 |
| CO-14 | Visual display (38) input: data bit #2 |
| CO-15 | Visual display (38) input: data bit #3 |
| CO-16 | Visual display (38) input: data bit #4 |
| CO-111 | Upstream control (33) |
| CO-112 | Visual display (38) input: data bit #5 |
| CO-113 | Visual display (38) input: data bit #6 |
| CO-114 | Alert strobe (35) |
| CO-115 | Visual display reset (37) |
| CO-116 | Flashing orange pilot light (39) |

The visual display unit 38 used in this embodiment is a Vorne Digital Display #2015C-L-120-C; Manufactured by Vorne Industries, Incorporated. Display unit 38 is a programmable digital display unit which may be programmed to display up to 255 messages in response to predetermined signals from the controller. In this embodiment, display unit 38 displays a plurality of predetermined messages in response to receipt of various signals from controller 36.

First differential pressure sensor switch 40 is an Omega Controls #PSW-152 which has a first and second pressure input, for sensing the pressure differential across compressed air line filter 26. The first pressure input is installed in connection with compressed air line 24 at a location downstream from compressed air line filter 26. The second pressure input is installed in connection with compressed air line 24 at a location upstream from compressed air line filter 26. First differential pressure sensor switch 40 has an electrical output in connection with an input of controller 36. Sensor switch 40 supplies an output signal to controller 36 when the differential pressure across compressed air line filter 26 exceeds 7 pounds per square inch.

Second differential pressure sensor switch 42 is a Columbus Electric #RH3A pressure differential switch that has a third and fourth pressure input, for sensing the pressure differential across pressurized air line filter 16. The third pressure input is installed in connection with pressurized air line 14 at a location downstream from pressurized air line filter 16. The fourth pressure input is installed in connection with pressurized air line 14 at a location upstream from pressurized air line filter 16. Second differential pressure sensor switch 42 has an electrical output in connection with an input of controller 36. Sensor switch 42 supplies an output signal to controller 36 when the differential pressure across pressurized air line filter 16 exceeds a 1 inch water column.

Third differential pressure sensor switch 44 is Columbus Electric #RH3A pressure differential switch that has a fifth and sixth pressure input, for sensing the pressure differential across vacuum air line filter 22. The fifth pressure input is installed connection with vacuum air line 20 at a location downstream from vacuum air line filter 22. The sixth pressure input is installed in connection with vacuum air line 20 at a location upstream from vacuum air line filter 22. Third differential pressure sensor switch 44 has an electrical output in connection with an input of controller 36. Sensor switch 44 supplies an output signal to controller 36 when the differential pressure across vacuum air line filter 22 exceeds a 1 inch water column.

Dew point monitor 46 is a Genesis dew point monitor, manufactured by General Eastern Instruments, Woburn, Mass. Dew point monitor 46 includes a dew point transducing element which is installed in connection with compressed air line 24, and an output connected to an input of controller 36. Dew point monitor 46 senses the dew point of the compressed air within compressed air line 24 and supplies an alarm signal to controller 36 when a predetermined set point level is sensed within compressed air line 24. In this embodiment, dew point monitor 46 is set to supply an alarm signal when the dew point of the compressed air within compressed air line 24 reaches 2 degrees Celsius.

Container gap sensor switch 48 is a Turck #Ni30-Q130-ADZ3OX2, which has an electrical output. The gap sensor is installed along the container filling queue in sufficient proximity to the container travel lane to detect the existence of a gap. The electrical output is connected to an input of controller 36. In this embodiment, container gap sensor switch 48 supplies an input signal to controller 36 when a gap of greater than about five inches is sensed between containers in the container cleaning queue.

Flow rate sensor switch 50 is a Turck #Ni30-K40-AZ3XB2131. In this embodiment container cleaner 10 includes flow meter 34 installed in-line with compressed air line 24. Flow meter 34 is of the type having a stainless steel ball installed within a clear tube having gradation markings along the side thereof. The flow rate is adjusted by turning a valve until the ball floats at the desired gradation marking. Flow rate sensor switch 50 includes a proximity sensor which is installed next to the tube at the desired flow rate level. Flow rate sensor 50 detects whether the ball is floating at the desired level. When flow rate sensor switch 50 detects the absence of the ball it supplies a signal to controller 36. In this embodiment flow rate sensor switch supplies the signal when the flow rate of the compressed air through the compressed air line falls outside of a range between about 250 and 350 cubic feet per hour.

Level detector mechanism 52 is an Omega Controls #LV-40 float switch which is installed within reservoir 30 of compressed air line regulator 28. In this embodiment compressed air line regulator 28 is a Parker #07E35B11AB, FA9, manufacture by Parker Fluid Power, Richland, Mich. Level detector mechanism 52 is installed within reservoir 30 by inserting a portion of the level detector mechanism through the existing drain hole. The drain hole is then sealed. Level detector mechanism 52 supplies a signal to an input of controller 36 when the fluid level with reservoir 30 reaches about 2 inches.

Operation of a container cleaner 10 having the monitoring system is simple. The container cleaner is started by pushing start button 11. At this time the compressed air solenoid opens, vacuum blower 18 and pressure blower 12 start, and both the upstream 33 and downstream 31 controls are held in the off state. The monitoring system then waits a predetermined period in order to allow the devices to stabilize.

The predetermined period is preferably about five seconds. Once the delay period has elapsed, controller 36 tests all inputs for the proper state. If the inputs indicate that operation of container cleaner 10 is in order, the upstream 33 and downstream 31 controls are changed to an on state and operation of the container cleaner 10 begins. When any fault or alarm condition occurs at any of the controller inputs, controller 36 initiates the preprogrammed action(s). This action could include, halting operation of the container cleaner 10, flashing a preprogrammed display on visual display unit 38, actuating flashing orange pilot light 39 and/or actuating alert strobe 35.

An exemplary method of monitoring the operations of a waterless container cleaner 10 is described with reference to FIG. 2. The method comprises the steps of: a) providing a monitoring system as previously described; b) installing the first pressure input in connection with compressed air line 24 at a location upstream compressed air line filter 26; c) installing the second pressure input in connection with compressed air line 24 at a location downstream from compressed air line filter 26; d) installing the third pressure input in connection with pressurized air line 14 at a location downstream from pressurized air line filter 16; e) installing the fourth pressure input in connection with pressurized air line 14 at a location upstream from pressurized air line filter 16; f) installing the fifth pressure input in connection with vacuum air line 20 at a location downstream from vacuum air line filter 22; and g) installing the sixth pressure input in connection with vacuum air line 20 at a location upstream from vacuum air line filter 22; h) installing level detector mechanism in connection with reservoir 30 of compressed air line regulator 28; i) installing flow rate sensor switch 50 in functional connection with compressed air line 24; and j) installing container gap sensor switch 48 in proximity to the container cleaning queue in a manner such that container gap sensor switch 48 may sense gaps within the container cleaning queue; k) installing the dew point transducing element in connection with compressed air line 24.

It can be seen from the preceding description that a method and device for monitoring the operation of a waterless container cleaner which monitors the pressure differential across the container cleaner's air filters, that monitors and detects a change in the flow rate of the container cleaner's compressed air line, a dew point detector which monitors the dampness of the air in the container cleaner's compressed air line, and a container gap sensor which provides a visual indication of the existence of a gap in the containers waiting to be cleaned has been provided.

It is noted that the embodiments of the waterless container cleaner monitoring system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A monitoring system for use in a waterless container cleaner having a container cleaning queue for holding a plurality of containers to be cleaned, a pressure blower, a pressurized air line having a pressurized air line filter, a vacuum blower, a vacuum air line having a vacuum air line filter, a compressed air line having a compressed air line filter, and a compressed air line regulator having a reservoir for collecting condensation within said compressed air line, said monitoring system comprising:

a digital controlled having a plurality of inputs and at least one output;

a visual display unit in electrical connection with said at least one output of said controller, said visual display unit displaying a plurality of predetermined messages in response to receipt of various signals from said controller;

a first differential pressure sensing means, having a first and second pressure input, for sensing the pressure differential across said compressed air line filter, said first pressure input being in functional connection with said compressed air line at a location downstream from said compressed air line filter, said second pressure input being in functional connection with said compressed air line at a location upstream from said compressed air line filter, said first differential pressure sensing means having a first electrical output in connection with a first one of said inputs of said controller, said first differential pressure sensing means supplying a first input signal to said controller when a predetermined pressure differential level is sensed across said compressed air line filter;

a second differential pressure sensing means, having a third and fourth pressure input, for sensing the pressure differential across said pressurized air line filter, said third pressure input being in functional connection with said pressurized air line at a location downstream from said pressurized air line filter, said fourth pressure input being in functional connection with said pressurized air line at a location upstream from said pressurized air line filter, said second differential pressure sensing means having a second electrical output in connection with a second one of said inputs of said controller, said second differential pressure sensing means supplying a second input signal to said controller when a predetermined pressure differential level is sensed across said pressurized air line filter;

a third differential pressure sensing means, having a fifth and sixth pressure input, for sensing the pressure differential across said vacuum air line filter, said fifth pressure input being in functional connection with said vacuum air line at a location downstream from said vacuum air line filter, said sixth pressure input being in functional connection with said vacuum air line at a location upstream from said vacuum air line filter, said third differential pressure sensing means having a third electrical output in connection with a third one of said inputs of said controller, said third differential pressure sensing means supplying a third input signal to said controller when a predetermined pressure differential level is sensed across said vacuum air line filter.

2. The waterless container cleaner monitoring system of claim 1, further including:

a container gap sensing means, having an electrical output in connection with a fourth one of said inputs of said controller, for detecting the presence of a gap between said containers in said container cleaning queue, said container gap sensing means supplying a fourth input signal to said controller when said gap between said containers in said container cleaning queue is sensed to exceed a predetermined size.

3. The waterless container cleaner monitoring system of claim 1, further including:

a flow rate sensing means, in connection with said compressed air line, for sensing the flow rate of compressed air through said compressed air line, said flow rate sensing means having an electrical output in connection with a fifth one of said inputs of said controller, said flow rate sensing means supplying a fifth input signal to said controller when the flow rate of said compressed air through said compressed air line falls outside of a predetermined flow rate range.

4. The waterless container cleaner monitoring system of claim 1, further including:

a dew point monitoring means, having a dew point transducing element in functional connection with said compressed air line of said waterless container cleaner, for sensing the dew point of the compressed air within said compressed air line, said dew point monitoring means having an electrical output, in connection with a sixth one of said inputs of said controller, said dew point monitoring means supplying a sixth input signal to said controller when a predetermined set point level is sensed within said compressed air line.

5. The waterless container cleaner monitoring system of claim 1 further including:

a level detector means, in functional connection with said reservoir of said compressed air line regulator, for sensing the level of accumulated condensation in said reservoir, said level detector means having an electrical output in connection with a seventh one of said plurality of inputs of said controller, said level detector means supplying a seventh input signal to said controller when a predetermined condensation level is sensed within said reservoir.

6. The waterless container cleaner monitoring system of claim 5, further including:

a flow rate sensing means, in connection with said compressed air line, for sensing the flow rate of compressed air through said compressed air line, said flow rate sensing means having an electrical output in connection with a fifth one of said inputs of said controller, said flow rate sensing means supplying a fifth input signal to said controller when the flow rate of said compressed air through said compressed air line falls outside of a predetermined flow rate range.

7. The waterless container cleaner monitoring system of claim 6, further including:

a container gap sensing means, having an electrical output in connection with a fourth one of said inputs of said controller, for detecting the presence of a gap in said container cleaning queue, said container gap sensing means supplying a fourth input signal to said controller when a gap greater than a predetermined size is sensed between containers in said container cleaning queue.

8. A monitoring system for use in a waterless container cleaner having a container cleaning queue for holding a plurality of containers to be cleaned and having a pressure blower, a pressurized air line having a pressurized air line filter, a vacuum blower, a vacuum air line having a vacuum air line filter, a compressed air line having a compressed air line filter, and a compressed air line regulator having a reservoir for collecting condensation within said compressed air line, said monitoring system comprising:

a digital controller having a plurality of inputs and at least one output;

a visual display unit in electrical connection with said at least one output of said controller, said visual display unit displaying a plurality of predetermined messages in response to receipt of various signals from said controller;

a moisture detector means, in functional connection with the compressed air within said compressed air line, for sensing the moisture level of the compressed air within said compressed air line, said moisture detector means having an electrical output in connection with a first one of said plurality of inputs of said controller, said moisture detector means supplying a first input signal to said controller when a predetermined moisture level is sensed within said compressed air line.

9. The waterless container cleaner monitoring system of claim 8 further including:

a container gap sensing means, having an electrical output in connection with a second one of said plurality of inputs of said controller, for detecting the presence of a gap in said container cleaning queue, said container gap sensing means supplying a second input signal to said controller when a gap greater than a predetermined size is sensed between containers in said container cleaning queue.

10. The waterless container cleaner monitoring system of claim 8 further including:

a flow rate sensing means, in connection with said compressed air line, for sensing the flow rate of compressed air through said compressed air line, said flow rate sensing means having an electrical output in connection with a third one of said plurality of inputs of said controller, said flow rate sensing means supplying a third input signal to said controller when the flow rate of said compressed air through said compressed air line falls outside of a predetermined flow rate range.

11. The waterless container cleaner monitoring system of claim 8, further including:

a first differential pressure sensing means, having a first and second pressure input, for sensing the pressure differential across said compressed air line filter, said first pressure input being in functional connection with said compressed air line at a location downstream from said compressed air line filter, said second pressure input being in functional connection with said compressed air line at a location upstream from said compressed air line filter, said first differential pressure sensing means having an electrical output in connection with a fourth one of said plurality of inputs of said controller, said first differential pressure sensing means supplying a fourth input signal to said controller when a predetermined pressure differential level is sensed across said compressed air line filter;

a second differential pressure sensing means, having a third and fourth pressure input, for sensing the pressure differential across said pressurized air line filter, said third pressure input being in functional connection with said pressurized air line at a location downstream from said pressurized air line filter, said fourth pressure input being in functional connection with said pressurized air line at a location upstream from said pressurized air line filter, said second differential pressure sensing means having an electrical output in connection with a fifth one of said plurality of inputs of said controller, said second differential pressure sensing means supplying a fifth input signal to said controller when a predetermined pressure differential level is sensed across said pressurized air line filter;

a third differential pressure sensing means, having a fifth and sixth pressure input, for sensing the pressure differential across said vacuum air line filter, said fifth pressure input being in functional connection with said vacuum air line at a location downstream from said vacuum air line filter, said sixth pressure input being in functional connection with said vacuum air line at a location upstream from said vacuum air line filter, said third differential pressure sensing means having an electrical output in connection with a sixth one of said plurality of inputs of said controller, said third differential pressure sensing means supplying a sixth input signal to said controller when a predetermined pressure differential level is sensed across said vacuum air line filter.

12. The waterless container cleaner monitoring system of claim 8 wherein said moisture detecting means includes a dew point monitoring means, having a dew point transducing element in functional connection with said compressed air line of a container cleaning system, for sensing the dew point of said compressed air within said compressed air line.

13. The waterless container cleaner monitoring system of claim 8 wherein said moisture detecting means includes:

a level detector means, in functional connection with said reservoir of said compressed air line regulator, for sensing the level of accumulated condensation in said reservoir, said level detector means having an electrical output in connection with a seventh one of said plurality of inputs of said controller, said level detector means supplying a seventh input signal to said controller when a predetermined condensation level is sensed within said reservoir.

14. The waterless container cleaner monitoring system of claim 13, further including:

a flow rate sensing means, in connection with said compressed air line, for sensing the flow rate of compressed air through said compressed air line, said flow rate sensing means having an electrical output in connection with a third one of said plurality of inputs of said controller, said flow rate sensing means supplying a third input signal to said controller when the flow rate of said compressed air through said compressed air line falls outside of a predetermined flow rate range.

15. The waterless container cleaner monitoring system of claim 14 further including:

a container gap sensing means, having an electrical output in connection with a second one of said plurality of inputs of said controller, for detecting the presence of a gap in said container cleaning queue, said container gap sensing means supplying a second input signal to said controller when a gap greater than a predetermined size is sensed between containers in said container cleaning queue.

16. A method of providing monitoring capability to a waterless container cleaner having a container cleaning queue for holding a plurality of containers to be cleaned and having a pressure blower, a pressurized air line having a pressurized air line filter, a vacuum blower, a vacuum air line having a vacuum air line filter, a compressed air line having a compressed air line filter, and a compressed air line regulator having a reservoir for collecting condensation within said compressed air line, said method comprising the steps of:

a) providing a monitoring system comprising:

a digital controller having a plurality of inputs and at least one output;

a visual display unit in electrical connection with said at least one output of said controller, said visual display unit displaying a plurality of predetermined messages in response to receipt of various signals from said controller;

a first differential pressure sensing means, having a first and second pressure input, for sensing the pressure differential across said compressed air line filter, said first differential pressure sensing means having an electrical output in connection with a first one of said plurality of inputs of said controller, said first differential pressure sensing means supplying a first input signal to said controller when a predetermined pressure differential level is sensed across said compressed air line filter;

a second differential pressure sensing means, having a third and fourth pressure input, for sensing the pressure differential across said pressurized air line filter, said second differential pressure sensing means having an electrical output in connection with a second one of said plurality of said controller, said second differential pressure sensing means supplying a second input signal to said controller when a predetermined pressure differential level is sensed across said pressurized air line filter;

a third differential pressure sensing means, having a fifth and sixth pressure input, for sensing the pressure differential across said vacuum air line filter, said third differential pressure sensing means having an electrical output in connection with a third one of said plurality of inputs of said controller, said third differential pressure sensing means supplying a third input signal to said controller when a predetermined pressure differential level is sensed across said vacuum air line filter;

b) installing said first pressure input in functional connection with said compressed air line at a location downstream from said compressed air line filter;

c) installing said second pressure input in functional connection with said compressed air line at a location upstream from said compressed air line filter;

d) installing said third pressure input in functional connection with said pressurized air line at a location downstream from said pressurized air line filter;

e) installing said fourth pressure input in functional connection with said pressurized air line at a location upstream from said pressurized air line filter;

f) installing said fifth pressure input in functional connection with said vacuum air line at a location downstream from said vacuum air line filter; and g) installing said sixth pressure input in functional connection with said vacuum air line at a location upstream from said vacuum air line filter.

17. The method of claim 16 wherein said monitoring system further comprises:

a level detector means for sensing the level of accumulated condensation in said reservoir, said level detector means having an electrical output in connection with a fourth one of said plurality of inputs of said controller, said level detector means supplying a fourth input signal to said controller when a predetermined condensation level is sensed within said reservoir; and wherein said method further includes the step of:

installing said level detector means in functional connection with said reservoir of said compressed air line regulator.

18. The method of claim 16 wherein said monitoring system further comprises:

a flow rate sensing means for sensing the flow rate of compressed air through said compressed air line, said flow rate sensing means having an electrical output in connection with a fifth one of said plurality of inputs of said controller, said flow rate sensing means supplying a fifth input signal to said controller when the flow rate of said compressed air through said compressed air line falls outside of a predetermined flow rate range; and wherein said method further includes the step of:

installing said flow rate sensing means in connection with said compressed air line.

19. The method of claim 16 wherein said monitoring system further comprises:

a container gap sensing means, having an electrical output in connection with a sixth one of said plurality of inputs of said controller, for detecting the presence of a gap between containers in said container cleaning queue, said container gap sensing means supplying a sixth input signal to said controller when a gap greater than a predetermined size is sensed between containers in said container cleaning queue; and wherein said method further includes the step of:

installing said container gap sensing means in proximity to said container cleaning queue in a manner such that said container gap sensing means may sense gaps within said container cleaning queue.

20. The method of claim 16 wherein said monitoring system further comprises:

a dew point monitoring means, having a dew point transducing element, for sensing the dew point of the compressed air within said compressed air line, said dew point monitoring means having an electrical output, in connection with a seventh one of said plurality of inputs of said controller, said sensing means supplying a seventh input signal to said controller when a predetermined set point level is sensed within said compressed air line, and said method further includes the step of:

installing said dew point transducing element in functional connection with said compressed air line of said container cleaning queue.

* * * * *